US010946413B2

(12) United States Patent
Hsieh et al.

(10) Patent No.: US 10,946,413 B2
(45) Date of Patent: Mar. 16, 2021

(54) SLOW-START PHOTOCURING DEVICE AND SWITCH CONTROL MODULE THEREOF

(71) Applicant: COSMEX CO., LTD., New Taipei (TW)

(72) Inventors: Wan Chieh Hsieh, New Taipei (TW); Hao-Hong Ciou, New Taipei (TW); Lin-Yu Sia, New Taipei (TW); Chun Ching Liu, New Taipei (TW)

(73) Assignee: COSMEX CO. LTD., New Taipei (TW)

( * ) Notice: Subject to any disclaimer, the term of this patent is extended or adjusted under 35 U.S.C. 154(b) by 0 days.

(21) Appl. No.: 16/671,923

(22) Filed: Nov. 1, 2019

(65) Prior Publication Data

US 2020/0171537 A1 Jun. 4, 2020

Related U.S. Application Data

(63) Continuation-in-part of application No. 15/952,619, filed on Apr. 13, 2018, now Pat. No. 10,492,258.

(30) Foreign Application Priority Data

Apr. 14, 2017 (TW) ..... 106205239

(51) Int. Cl.
*B05D 3/06* (2006.01)
*A45D 29/00* (2006.01)

(52) U.S. Cl.
CPC ..... *B05D 3/067* (2013.01); *A45D 29/00* (2013.01)

(58) Field of Classification Search
CPC .... A45D 29/00; A45D 31/00; H05B 33/0807; H05B 33/0809; H05B 33/0815; H05B 33/0818; B05D 3/067; F26B 3/30
See application file for complete search history.

(56) References Cited

U.S. PATENT DOCUMENTS

2002/0015662 A1* 2/2002 Hlavinka ..... A61L 2/08 422/24
2009/0073271 A1 3/2009 Grenlund et al.
2009/0160364 A1 6/2009 Ackermann et al.
2009/0190349 A1 7/2009 Middlemass et al.
2011/0277338 A1 11/2011 Li et al.
2011/0300505 A1* 12/2011 Jessop ..... A61C 19/003 433/29

(Continued)

*Primary Examiner* — David E Smith
(74) *Attorney, Agent, or Firm* — Muncy, Geissler, Olds & Lowe, P.C.

(57) ABSTRACT

The present invention provides a slow-start photocuring device, comprising: a housing, an ultraviolet (UV) light-emitting diode (LED) module, and a switch control module. The housing has an inner side provided with an internal cavity, wherein the inner side of the housing is further provided with one or a plurality of openings on one or two sides of the internal cavity. The UV LED module is provided around the internal cavity, wherein the UV LED module has a light-emitting side facing the internal cavity. The switch control module is connected to the UV LED module, wherein the switch control module includes a signal modulator, the signal modulator activates a buffer mode when receiving a trigger signal, and the UV LED module in the buffer mode outputs light of a plurality of brightness levels sequentially according to an output signal of the signal modulator.

9 Claims, 17 Drawing Sheets

(56) References Cited

U.S. PATENT DOCUMENTS

| | | | | |
|---|---|---|---|---|
| 2015/0184938 | A1 | 7/2015 | Tanihara | |
| 2016/0370113 | A1* | 12/2016 | Valia | F26B 3/28 |
| 2016/0374167 | A1 | 12/2016 | Aliakseyeu et al. | |
| 2017/0127790 | A1* | 5/2017 | Huang | A45D 29/00 |

* cited by examiner

SLOW-START PHOTOCURING DEVICE AND SWITCH CONTROL MODULE THEREOF

BACKGROUND OF THE INVENTION

1. Technical Field

The present invention relates to a photocuring device and more particularly to a slow-start photocuring device for photocurable artificial fingernails.

2. Description of Related Art

Photocurable artificial fingernails are imitation fingernails formed by curing a photocurable gel with ultraviolet (UV) light. Made of natural resins, such photocurable gels not only can protect the nail surface, but also can form a protective layer that adds to the thickness of the underlying natural nails, thereby keeping the natural nails from cracking or breaking. Photocurable artificial nails can also be used to correct nail shapes and beautify natural nails effectively. Two major advantages of photocurable artificial nails are eco-friendliness and harmlessness to human health. No irritating smell is produced during the photocuring process, and the reinforced nails can be polished with ease, are less likely to curl than in their natural state, and have a visually pleasing sheen.

However, some gels tend to react with the light of UV light-emitting diodes (LEDs) and generate a considerable amount of heat. If the light is output at full power during the entire curing process, gel temperature may rise abruptly, causing a burning or otherwise uncomfortable sensation in the fingers involved. The inventor of the present invention found it necessary to provide a solution to the aforesaid problem.

BRIEF SUMMARY OF THE INVENTION

The primary objective of the present invention is to provide a slow-start photocuring device, comprising: a housing, an ultraviolet (UV) light-emitting diode (LED) module, and a switch control module. The housing has an inner side provided with an internal cavity, wherein the inner side of the housing is further provided with one or a plurality of openings on one or two sides of the internal cavity. The UV LED module is provided around the internal cavity, wherein the UV LED module has a light-emitting side facing the internal cavity. The switch control module is connected to the UV LED module, wherein the switch control module includes a signal modulator, the signal modulator activates a buffer mode when receiving a trigger signal, and the UV LED module in the buffer mode outputs light of a plurality of brightness levels sequentially according to an output signal of the signal modulator.

Another objective of the present invention is to provide a slow-start photocuring device, comprising: a housing, an ultraviolet (UV) light-emitting diode (LED) module, and a switch control module. The housing has an inner side provided with an internal cavity, wherein the inner side of the housing is further provided with one or a plurality of openings on one or two sides of the internal cavity. The UV LED module comprises a plurality of UV LED units provided around the internal cavity, wherein the UV LED units are of different wavelengths, and the UV LED units have a light-emitting side facing the internal cavity. The switch control module is connected to the UV LED module, wherein the switch control module includes a signal modulator, the signal modulator activates a buffer mode when receiving a trigger signal, and the UV LED module in the buffer mode instructs the UV LED units of different wavelengths to output light of a plurality of brightness levels separately and sequentially according to an output signal of the signal modulator.

Still another objective of the present invention is to provide a slow-start photocuring device, comprising: a housing, an ultraviolet (UV) light-emitting diode (LED) module, and a switch control module. The housing has an inner side provided with an internal cavity, wherein the inner side of the housing is further provided with one or a plurality of openings on one or two sides of the internal cavity. The UV LED module comprises a plurality of UV LED units provided in a plurality of different areas in the internal cavity respectively, and the UV LED module has a light-emitting side facing the internal cavity. The switch control module is connected to the UV LED module, wherein the switch control module includes a signal modulator, the signal modulator activates a buffer mode when receiving a trigger signal, and the UV LED module in the buffer mode instructs the UV LED units in the different areas to output light of a plurality of brightness levels separately and sequentially according to an output signal of the signal modulator.

Yet another objective of the present invention is to provide a slow-start photocuring device, comprising: a housing, an ultraviolet (UV) light-emitting diode (LED) module, and a switch control module. The housing has an inner side provided with an internal cavity, wherein the inner side of the housing is further provided with one or a plurality of openings on one or two sides of the internal cavity. The UV LED module is provided around the internal cavity, wherein the UV LED module has a light-emitting side facing the internal cavity. The switch control module is connected to the UV LED module, wherein the switch control module includes an output adjustment device for adjusting, according to a control signal received thereby, a power output to the UV LED module.

DETAILED DESCRIPTION OF THE INVENTION

The details and technical solution of the present invention are hereunder described with reference to accompanying drawings.

Figure 1:
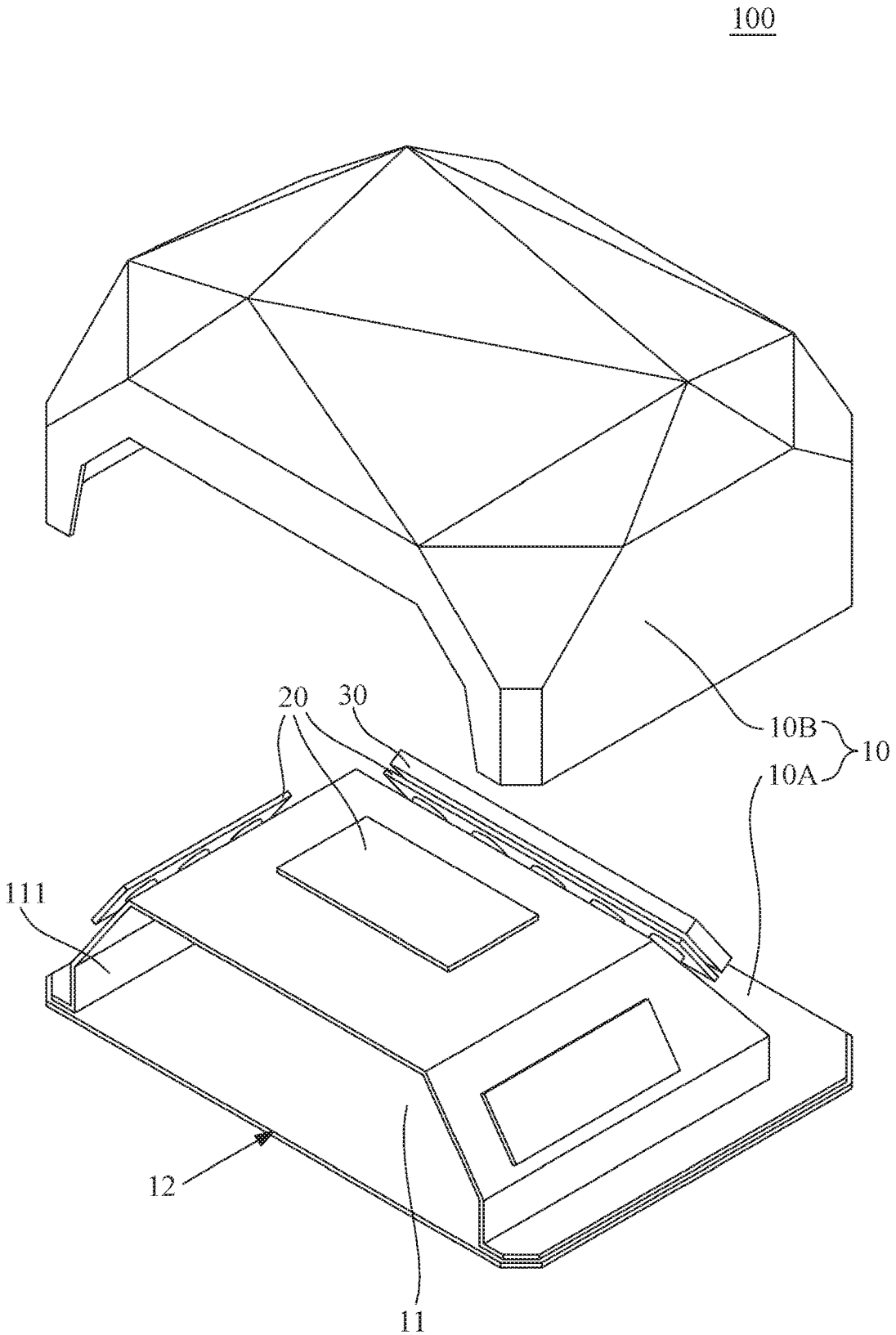
FIG. 1 is a perspective view of a photocuring device according to the present invention.

Please refer to FIG. 1 for a perspective view of a photocuring device according to the present invention.

As shown in FIG. 1, the photocuring device 100 includes a housing 10, one or a plurality of UV LED modules 20 provided in the housing 10, and a switch control module 30 provided in the housing 10 and connected to the one or the plurality of UV LED modules 20.

The housing 10 includes an inner housing portion 10A and an outer housing portion 10B. The inner housing portion 10A and the outer housing portion 10B form a space therebetween in which the UV LED modules 20 and the switch control module 30 are provided. The inner housing portion 10A extends inward of the housing 10 to form an internal cavity 11. The internal cavity 11 has an opening 12 on one side so that a user's fingers can be placed into the opening. In another preferred embodiment, the inner housing portion is arch-shaped and is bilaterally provided with openings that are in communication with the internal cavity, allowing a user's fingers to extend into the internal cavity from two lateral sides. The present invention has no limitation on the shape of the inner housing portion or the number or arrangement of the aforesaid openings. In another embodiment, the switch control module 30 can also be provided on any position of the housing 10; the present invention has no limitation in this regard.

The internal cavity 11 is peripherally provided with a plurality of walls 111, and the walls 111 are formed with a plurality of through holes (not shown) so that the light-emitting sides the UV LED modules 20 provided around the internal cavity 11 can project light into the internal cavity 11 through the through holes.

The switch control module 30 may be a circuit board and the circuits and electronic components integrated with the circuit board. In another preferred embodiment, the switch control module 30 may be two or more circuit boards and the circuits and electronic components integrated with the circuit boards, wherein some of the electronic components or circuits are integrated with more than one circuit board. The present invention has no limitation on the configuration of the switch control module 30.

Figure 2:
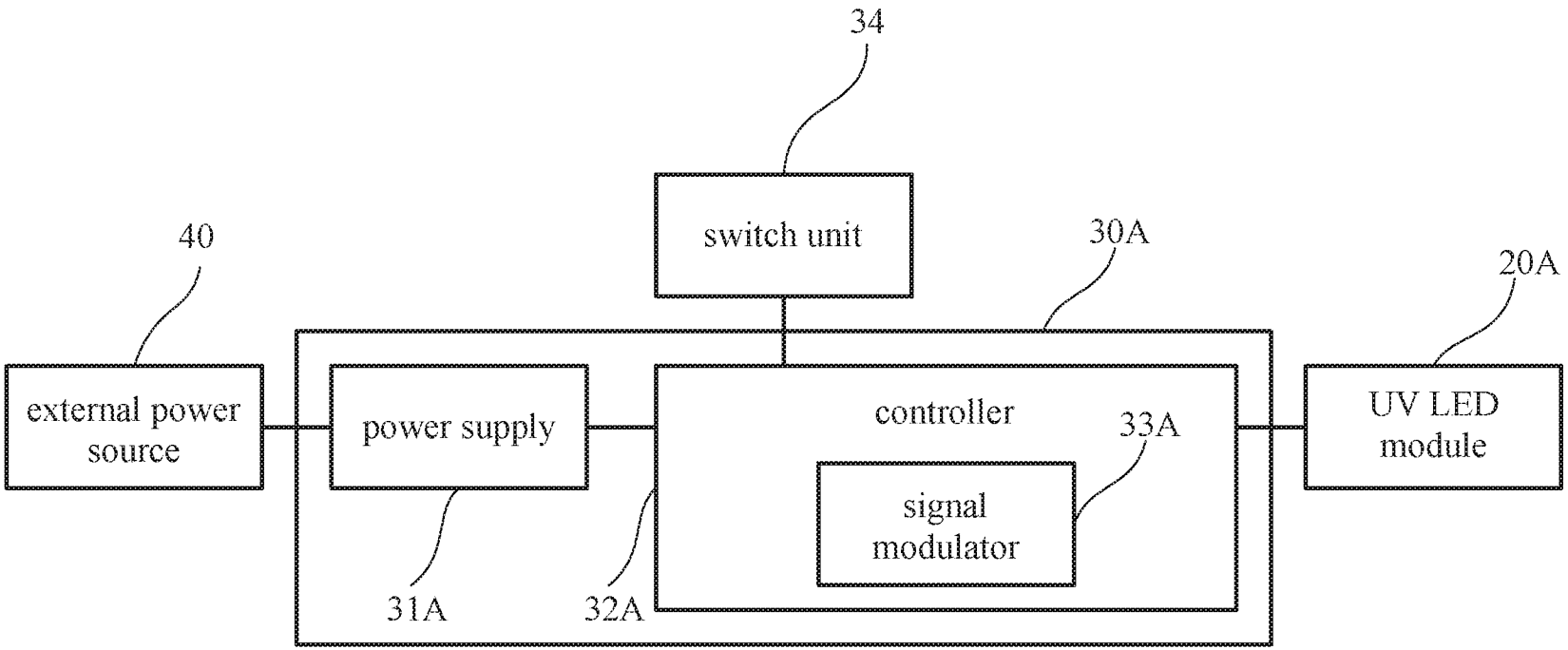
FIG. 2 is a block diagram of the first embodiment of the invention.

Based on the gel heat buffering solution of the present invention, a feasible embodiment is presented below for illustration. Please refer to FIG. 2 for a block diagram of the first embodiment of the invention.

The switch control module 30A includes a power supply 31A, a controller 32A provided at the rear end of the power supply 31A, and a signal modulator 33A constructed together with the controller 32A to form a single processor. It is worth mentioning that the signal modulator 33A and the controller 32A may be implemented as separate chips instead; the present invention has no limitation in this regard. The power supply 31A is connected to an external power source 40 and is configured to provide electricity to the controller and the other electrically driven components. In one preferred embodiment, the power supply 31A is integrated with a rectifier and filter unit, a power factor correction unit, a transformer, a power modulation unit, or other similar power supply circuits; the present invention has no limitation in this regard. In another preferred embodiment, the power supply 31A is implemented as an external transformer or power adapter; the present invention has no limitation in this regard, either.

The controller 32A may receive a trigger signal through a switch unit 34 or be programed to generate the trigger signal when a preset condition is met; the present invention has no limitation in this regard. The switch unit 34 may be an input device or sensing device to be pressed or triggered by a user (e.g., a physical press-button, a touch control button, or an optical shutter) or a wireless transmission unit connected to the controller 32A so that a user can control the controller 32A through wireless transmission; the present invention has no limitation in this regard.

The signal modulator 33A activates a buffer mode when receiving the trigger signal. In the buffer mode, the UV LED module 20A outputs light of different brightness levels according to the output signal of the signal modulator 33A. In one feasible embodiment, the signal modulator 33A may be a pulse width modulator (PWM), a pulse frequency modulator (PFM), an amplitude modulator (AM), or a pulse amplitude modulator (PAM); the present invention has no limitation in this regard.

As used herein, the term "output signal" refers to the modulation signal output by the signal modulator according to the instruction of the controller in the control module, and the modulation signal may be a pulse width modulation signal, a pulse frequency modulation signal, an amplitude modulation signal, or a pulse amplitude modulation signal without limitation. The modulation signal is used to drive the UV LED module to output light of different brightness levels.

As used herein, the term "brightness level" refers to the radiant flux the UV LED module is driven to produce by the output signal. The brightness level does not refer to a signal but to the output wattage of the UV LED module.

For the first embodiment, a number of light-emitting modes are provided to cater for the properties of different gels and to enhance curing as well as reduce the discomfort resulting from the heat generated by the gel in use. Please refer to FIG. 3, FIG. 4, FIG. 5, and FIG. 6 for the brightness level variations in those light-emitting modes respectively.

In one preferred embodiment, the signal modulator 33A activates a buffer mode when receiving the trigger signal, and the UV LED module 20A in the buffer mode outputs light of a plurality of brightness levels sequentially according to the output signal of the signal modulator.

Figure 3:
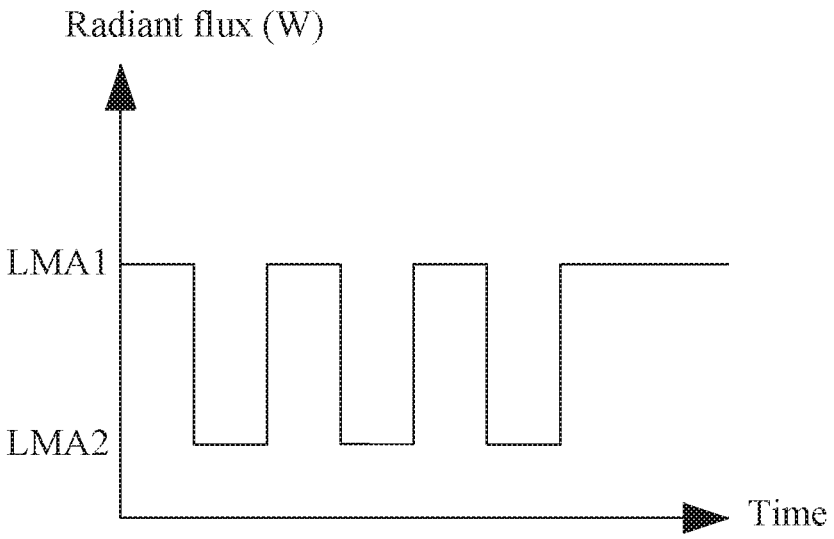
FIG. 3 shows the brightness level variations I of the first embodiment of the invention.

In one feasible embodiment, referring to FIG. 3, the UV LED module 20A in the buffer mode outputs light of a first brightness level LMA1 (e.g., a relatively high brightness level) and a second brightness level LMA2 (e.g., a relatively low brightness level) alternately according to the output signal of the signal modulator 33A. The ratio between the duration of light emission at the first brightness level LMA1 and the duration of light emission at the second brightness level LMA2 is designed to buffer the heat generated by the gel and to enhance curing.

Figure 4:
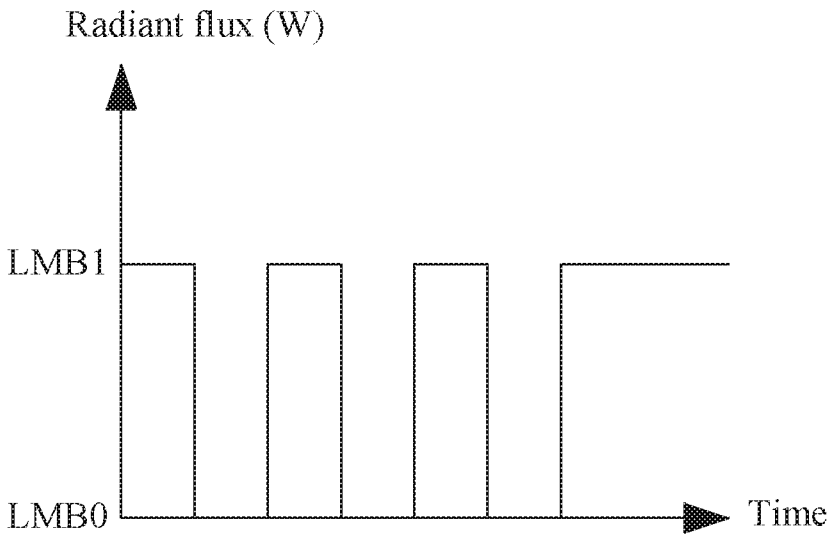
FIG. 4 shows the brightness level variations II of the first embodiment of the invention.

In another feasible embodiment, referring to FIG. 4, the UV LED module 20A in the buffer mode outputs light of a high brightness level LMB1 and a zero brightness level LMB0 alternately according to the output signal of the signal modulator 33A. The state in which the zero brightness level LMB0 takes place is intended to provide the gel with enough cooling time to reduce the discomfort resulting from the heat generated by the gel. The zero brightness level LMB0 may be caused by an output signal whose power is zero or at most the minimum voltage for driving the UV LED module 20A; the present invention has no limitation in this regard.

Figure 5:
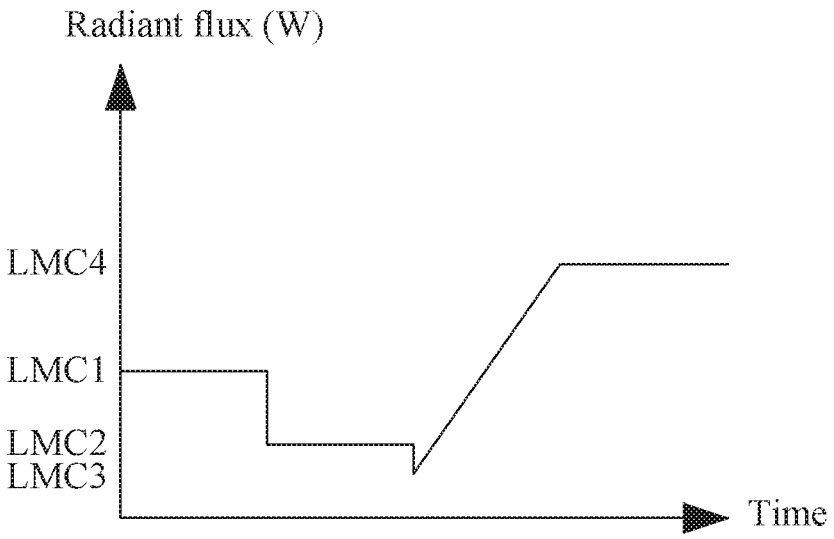
FIG. 5 shows the brightness level variations III of the first embodiment of the invention.

In still another feasible embodiment, referring to FIG. 5, according to the output signal of the signal modulator 33A, the UV LED module 20A in the buffer mode outputs light of a plurality of brightness levels (e.g., brightness levels LMC1 and LMC2) sequentially, then outputs light whose brightness level is gradually modulated from a first brightness level LMC3 (or the brightness level LMC2) to a second brightness level LMC4, and, once the second brightness level LMC4 is reached, continues with the second brightness level LMC4 (or switches to other brightness levels) until the activation time comes to an end. Here, the term "gradually modulated" refers to the process of gradually increasing the power of the UV LED module such that the radiant flux from the UV LED module rises from the first brightness level (as the starting level) to the second brightness level. During the process, a buffering effect can be produced by modulating the unit step or unit pulse.

Figure 6:
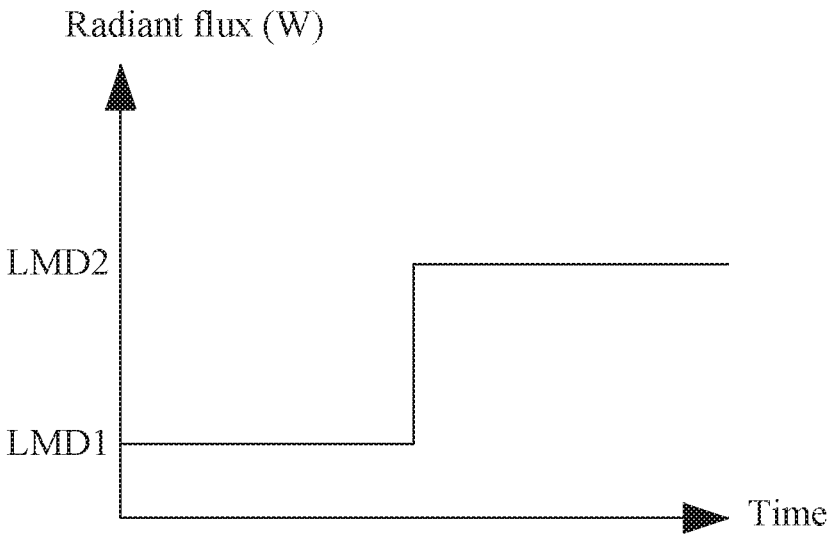
FIG. 6 shows the brightness level variations IV of the first embodiment of the invention.

In yet another feasible embodiment, referring to FIG. 6, according to the output signal of the signal modulator 33A, the UV LED module 20A in the buffer mode begins by outputting light of a first brightness level LMD1 (e.g., a relatively low brightness level) as a buffering output and, once the buffer time comes to an end, switches to and stays at a second brightness level LMD2 (e.g., a relatively high brightness level) (or switches to the second brightness level LMD2 and then to other brightness levels). The duration of the first brightness level is intended to buffer the heat generated by the gel.

It should be pointed out that a brightness level can be switched to another brightness level by being "gradually modulated" rather than in the form of pulses (square waves). In addition, a relatively high brightness level is not necessarily a brightness level at which light is stably output.

Furthermore, the various embodiments described above are only some alternative forms of the present invention and should not be construed as restrictive of the scope of the invention. Any embodiment that produces a buffering effect by modulating the brightness level of the UV LED module 20A should fall within the scope of the invention.

Figure 7:
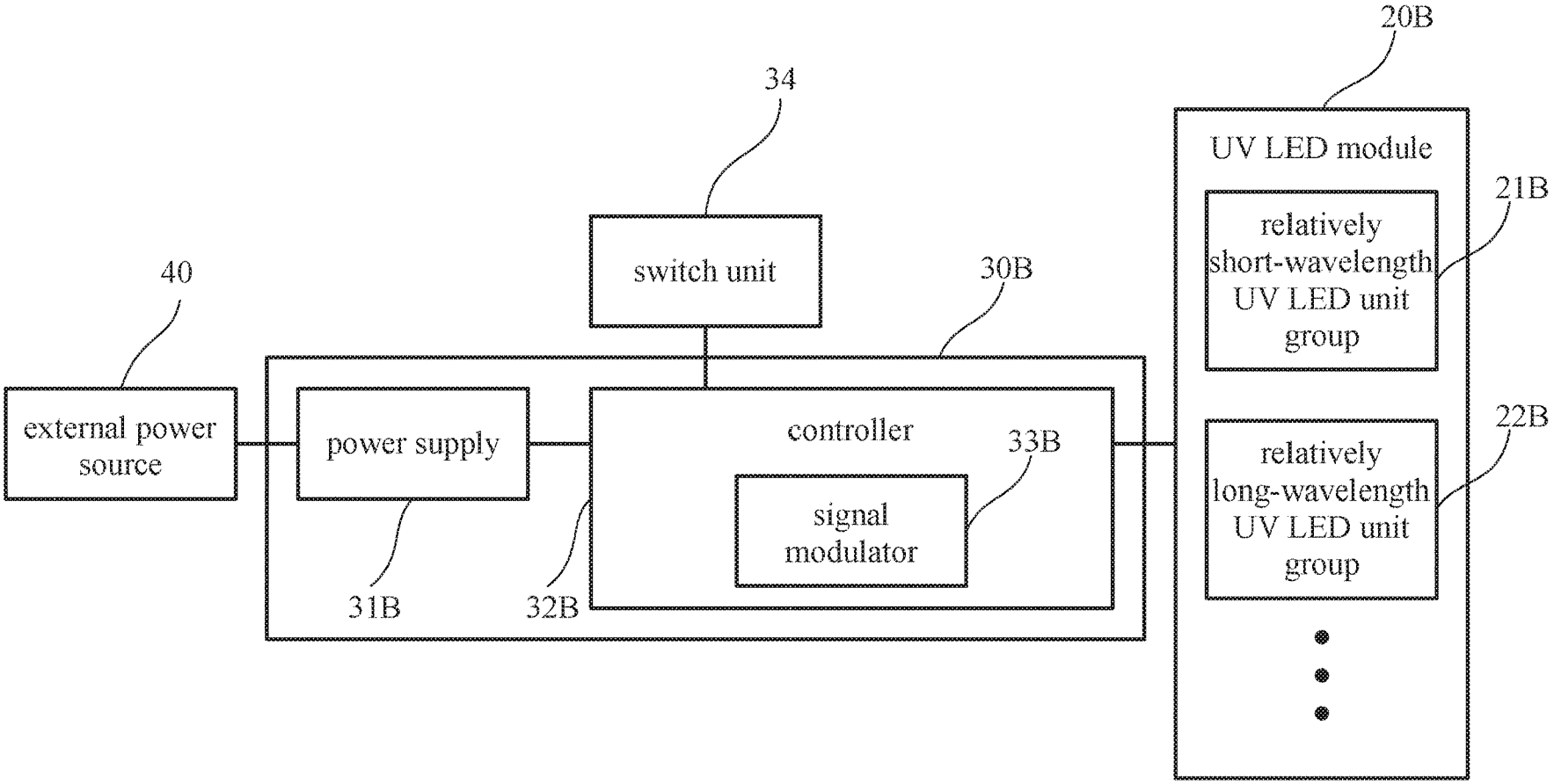
FIG. 7 is a block diagram of the second embodiment of the invention.

Based on the gel heat buffering solution of the present invention, another feasible embodiment is presented below for illustration. Please refer to FIG. 7 for a block diagram of the second embodiment of the invention.

The second embodiment has generally the same exterior configuration as the first embodiment and is different from the first embodiment only in the choice and configuration of the UV LED module. For the sake of brevity, those portions of the second embodiment that are identical to their counterparts in the first embodiment will not be described repeatedly.

In the second embodiment, the switch control module 30B includes a power supply 31B, a controller 32B provided at the rear end of the power supply 31B, and a signal modulator 33B.

In the second embodiment, the UV LED module 20B includes a plurality of UV LED units provided around the internal cavity. The UV LED units are configured to emit light of different wavelengths, and the light-emitting sides of the UV LED units face the internal cavity. The UV LED units, which are of different wavelengths, may have a divided circuit design. For example, the circuits of those relatively short-wavelength UV LED units may be separated from the circuits of those relatively long-wavelength UV LED units to form a relatively short-wavelength UV LED unit group 21B and a relatively long-wavelength UV LED unit group 22B, making it easier for the signal modulator to control the circuits by groups. In the present invention, a UV LED unit group may include UV LED units of different wavelengths without limitation. For example, a UV LED unit group may include UV LED units of at least two (e.g., three or more than three) wavelengths; the invention has no limitation in this regard. UV LED unit groups of different wavelengths may be provided on the same circuit board or on a plurality of separate circuit boards; the invention has no limitation in this regard, either.

When receiving the trigger signal, the signal modulator 33B of the switch control module 30B activates a buffer mode in which the UV LED module 20B instructs the different-wavelength UV LED units (e.g., the relatively short-wavelength UV LED unit group 21B and the relatively long-wavelength UV LED unit group 22B) to output light of different brightness levels separately and sequentially according to the output signal of the signal modulator 33B.

For the second embodiment, a number of light-emitting modes are also provided to cater for the properties of different gels and to enhance curing as well as reduce the discomfort resulting from the heat generated by the gel in use. Please refer to FIG. 8, FIG. 9, and FIG. 10 for the brightness level variations in those light-emitting modes respectively.

Figure 8:
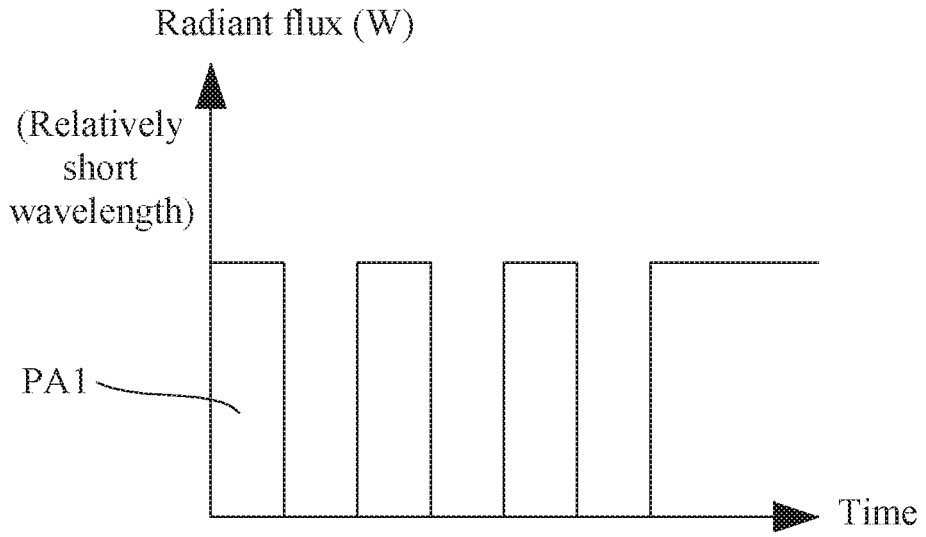
FIG. 8 shows the brightness level variations I of the second embodiment of the invention.
Figure 8:
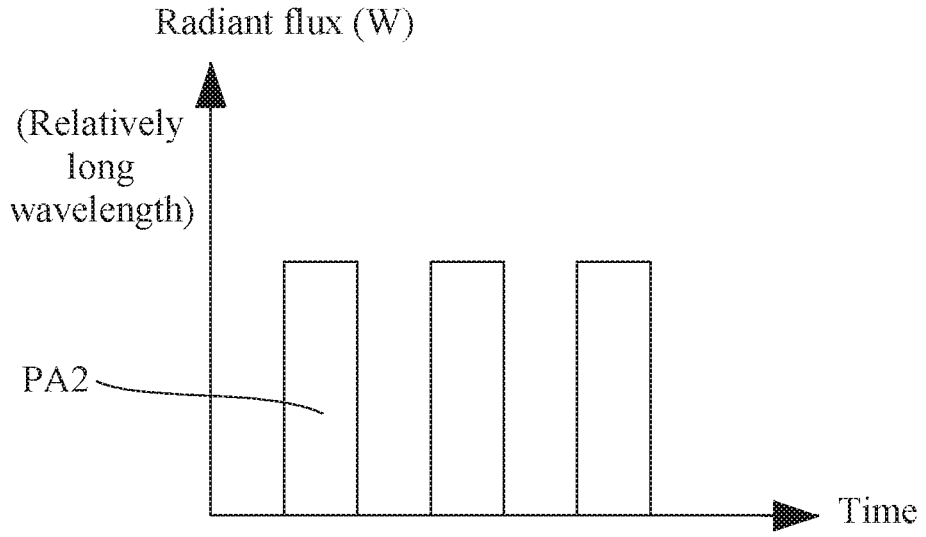

Referring to FIG. 8, the UV LED module 20B in the buffer mode drives the relatively short-wavelength UV LED unit group 21B and the relatively long-wavelength UV LED unit group 22B separately and sequentially according to the output signal of the signal modulator 33B such that the activation square waves PA1 and PA2 do not overlap (or at least do not overlap completely). By switching between the two different wavelengths (or two different groups of wavelengths) and controlling the light-emitting time ratio between the different-wavelength UV LED units, the heat generated by the gel can be buffered, and the curing of the gel, enhanced.

Figure 9:
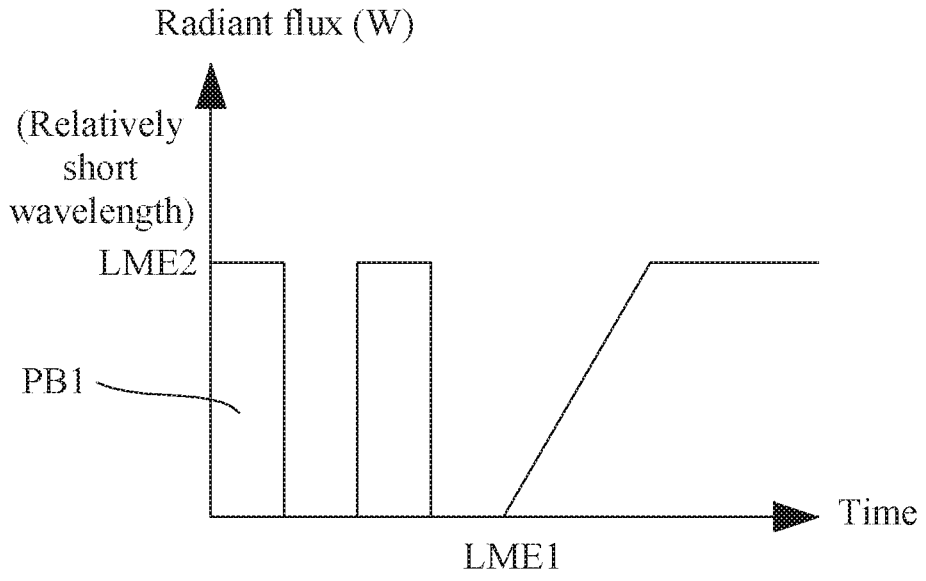
FIG. 9 shows the brightness level variations II of the second embodiment of the invention.
Figure 9:
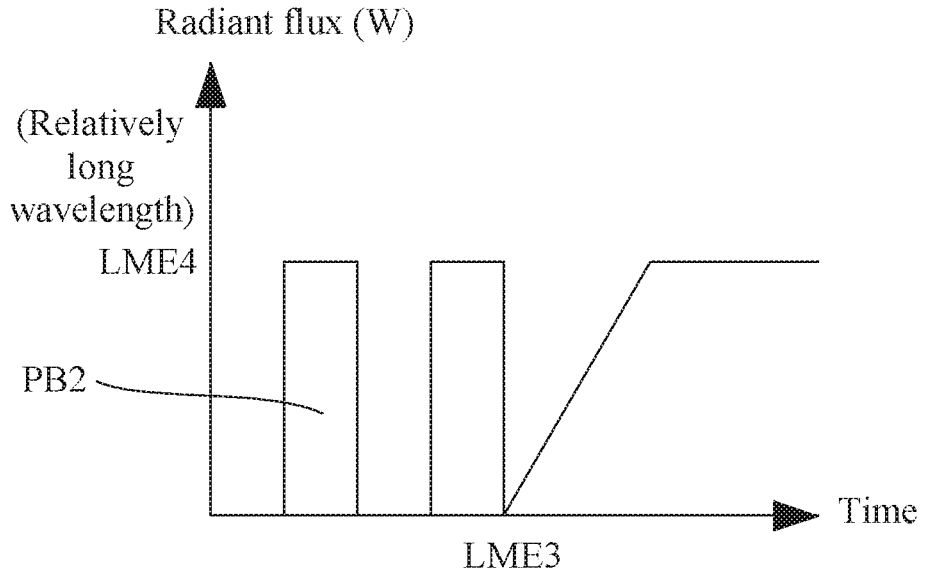

In another feasible embodiment, referring to FIG. 9, the UV LED module 20B in the buffer mode responds to the output signal of the signal modulator by first driving the switches of the relatively short-wavelength UV LED unit group 21B and of the relatively long-wavelength UV LED unit group 22B alternately; as a result, either the activation square waves PB1 and PB2 do not overlap (or at least do not overlap completely), or whichever UV LED unit group is being triggered has its brightness level increased while the other UV LED unit group has its brightness level decreased. Then, the brightness level of the relatively short-wavelength UV LED unit group 21B is gradually modulated from a first brightness level LME1 to a second brightness level LME2, and at the same time, the brightness level of the relatively long-wavelength UV LED unit group 22B is gradually modulated from a first brightness level LME3 to a second brightness level LME4. Once the second brightness level LME2 or LME4 is reached, the corresponding UV LED unit group 21B or 22B continues with that second brightness level (or switches to other brightness levels) until the activation time comes to an end. Here, the term "gradually modulated" refers to the process of gradually increasing the power of a UV LED module such that the radiant flux from the UV LED module rises from the corresponding first brightness level (as the starting level) to the corresponding second brightness level. During the process, a buffering effect can be produced by modulating the unit step or unit pulse.

Figure 10:
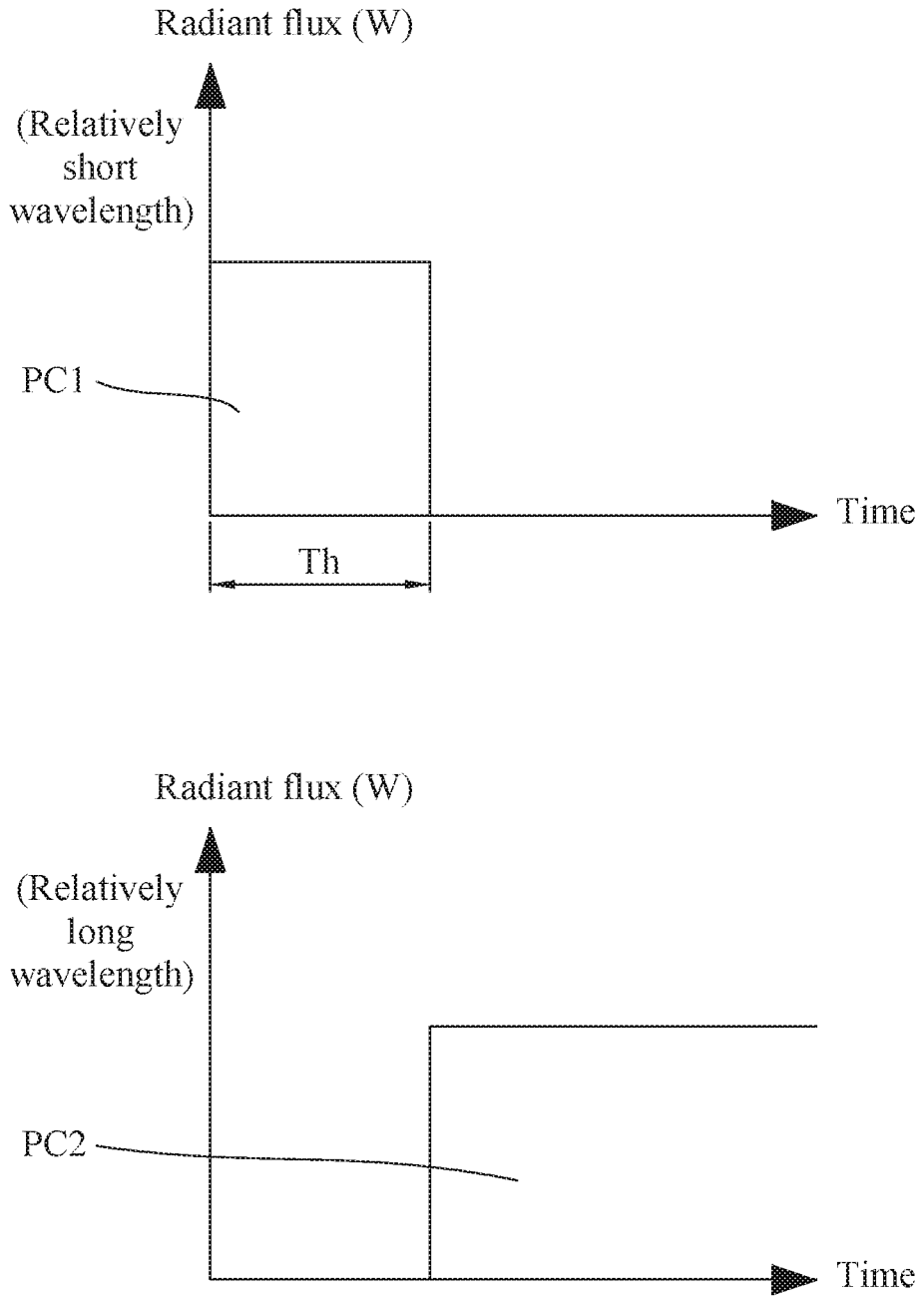
FIG. 10 shows the brightness level variations III of the second embodiment of the invention.

In still another feasible embodiment, referring to FIG. 10, the UV LED module in the buffer mode responds to the output signal of the signal modulator by first activating the relatively short-wavelength UV LED unit group 21B to produce a buffering output (i.e., to output the square wave PC1). Once the buffer time Th comes to an end, the UV LED module activates the relatively long-wavelength UV LED unit group 22B instead (or keeps activating the relatively short-wavelength UV LED unit group 21B and activates the relatively long-wavelength UV LED unit group 22B in addition) in order for the relatively long-wavelength UV LED unit group 22B (or both the UV LED unit group 21B and 22B) to produce a steady output (i.e., the square wave PC2). The time for which the relatively short-wavelength UV LED unit group 21B is activated is intended to buffer the heat generated by the gel.

It should be pointed out that the switching between the different-wavelength UV LED units can also be achieved by the signal modulator 33B modulating the output power of the UV LED units; the present invention has no limitation in this regard. This alternative switching approach not only serves to control the brightness level of each UV LED unit group, but also enables a wider variation of brightness levels.

Figure 11:
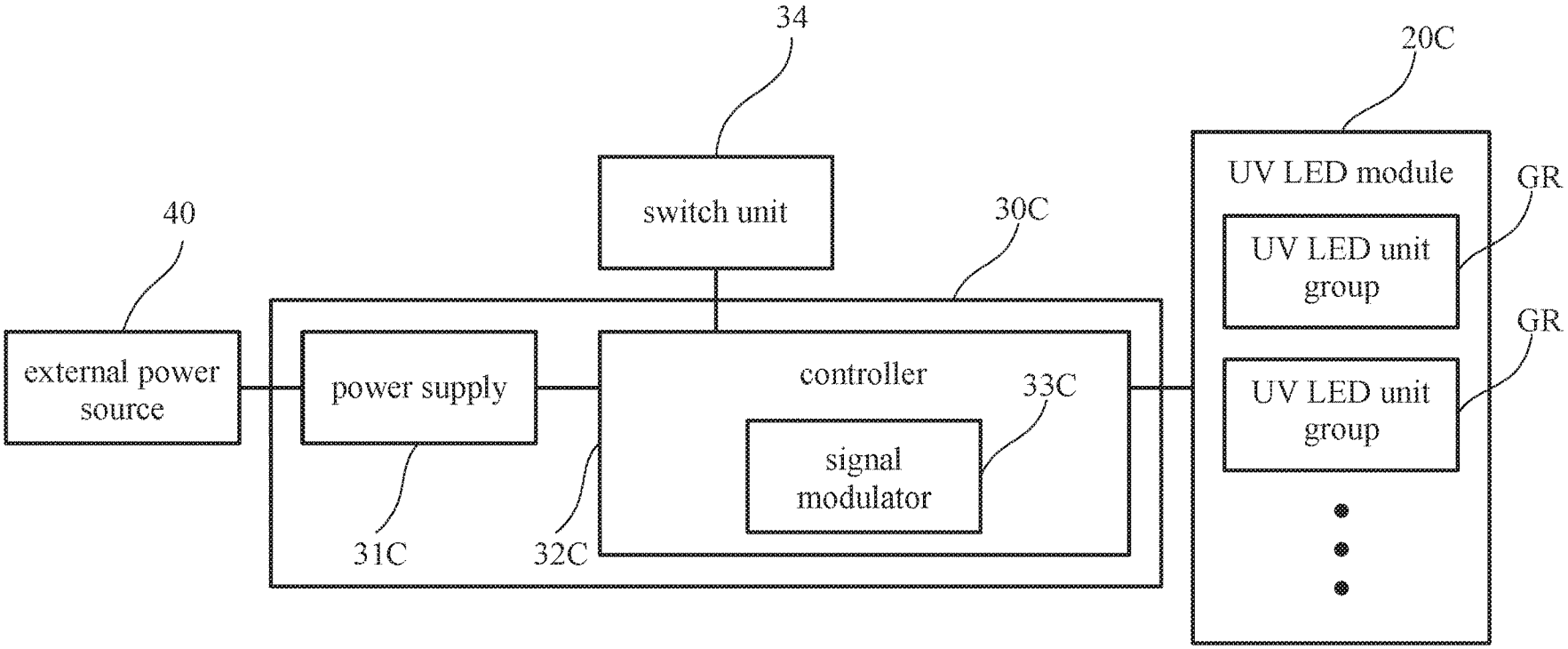
FIG. 11 is a block diagram of the third embodiment of the invention.

Based on the gel heat buffering solution of the present invention, yet another feasible embodiment is presented below for illustration. Please refer to FIG. 11 for a block diagram of the third embodiment of the invention.

In the third embodiment, the switch control module 30C includes a power supply 31C, a controller 32C provided at the rear end of the power supply 31C, and a signal modulator 33C.

The third embodiment has generally the same exterior configuration as the first embodiment and is different from the first embodiment only in the arrangement of the UV LED units in the UV LED module. For the sake of brevity, those portions of the third embodiment that are identical to their counterparts in the first embodiment will not be described repeatedly.

In the third embodiment, the UV LED module 20C includes a plurality of UV LED units arranged respectively in a plurality of different areas in the internal cavity. The light-emitting side of the UV LED module faces the internal cavity. The UV LED units may have a divided circuit design, making it easier for the signal modulator 33C to control the circuits by groups. The UV LED units may form two or more UV LED unit groups GR; the present invention has no limitation in this regard. The UV LED unit groups GR may be provided on the same circuit board or on a plurality of separate circuit boards; the invention has no limitation in this regard, either.

For the third embodiment, a number of light-emitting modes are also provided to cater for the properties of different gels and to enhance curing as well as reduce the discomfort resulting from the heat generated by the gel in use. Please refer to FIG. 12, FIG. 13, FIG. 14, FIG. 15, and FIG. 16 for some examples of the configuration of the UV LED module in the third embodiment.

Figure 12:
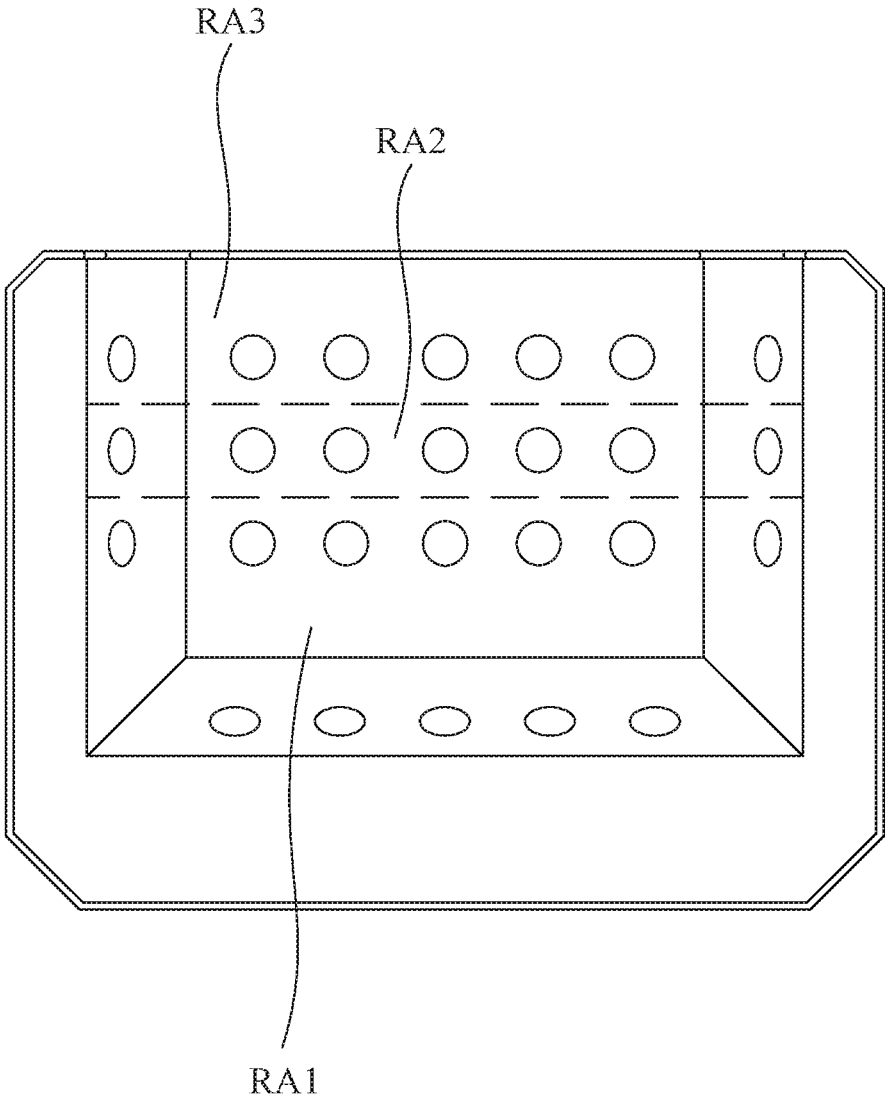
FIG. 12 is a first configuration of the UV LED module in the third embodiment of the invention.

Referring to FIG. 12, the UV LED unit groups are arranged in an inside-to-outside manner (i.e., from an inner portion of the cavity toward an outer portion of the cavity). For example, the UV LED units are divided, from an inner cavity portion toward an outer cavity portion, into a UV LED unit group RA1, a UV LED unit group RA2, and a UV LED unit group RA3 so that the switches of the UV LED units can be driven in an inside-to-outside sequence, an outside-to-inside sequence, or any other sequence in order to produce the desired buffering effect and enhance the curing of the gel.

Figure 13:
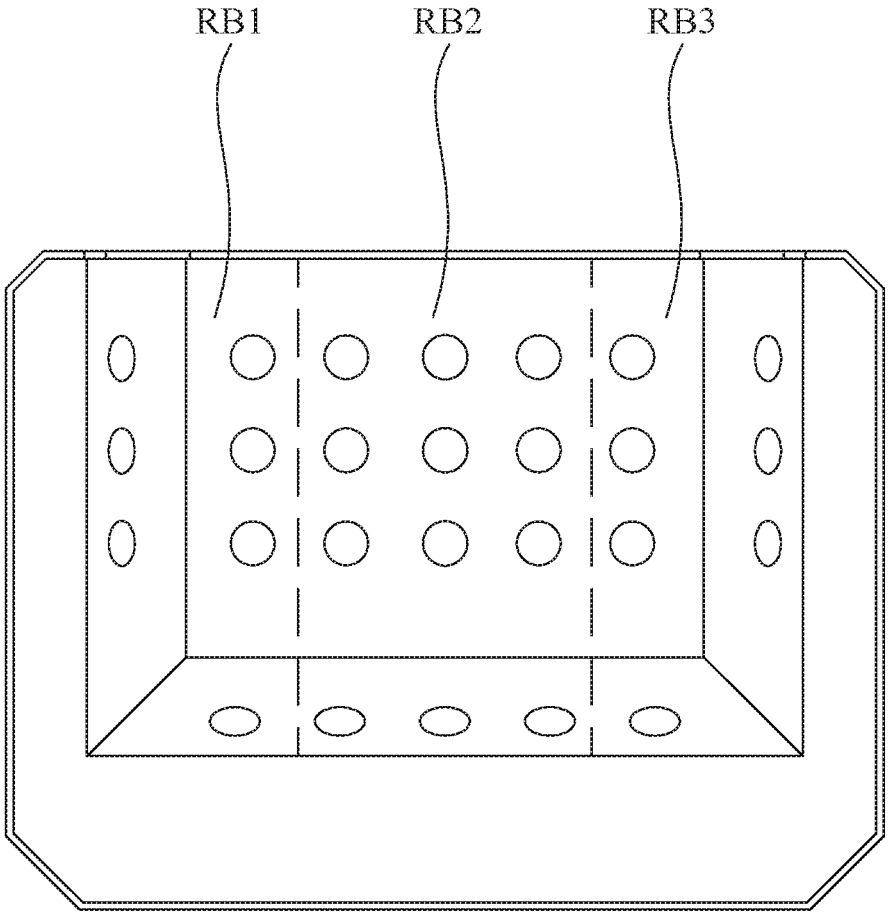
FIG. 13 is a second configuration of the UV LED module in the third embodiment of the invention.

In another feasible embodiment, referring to FIG. 13, the UV LED unit groups are arranged in a left-to-right manner. For example, the UV LED units are divided, from left to right, into a UV LED unit group RB1, a UV LED unit group RB2, and a UV LED unit group RB3 so that the switches of the UV LED units can be driven in a left-to-right sequence, a right-to-left sequence, or any other sequence in order to produce the desired buffering effect and enhance the curing of the gel.

Figure 14:
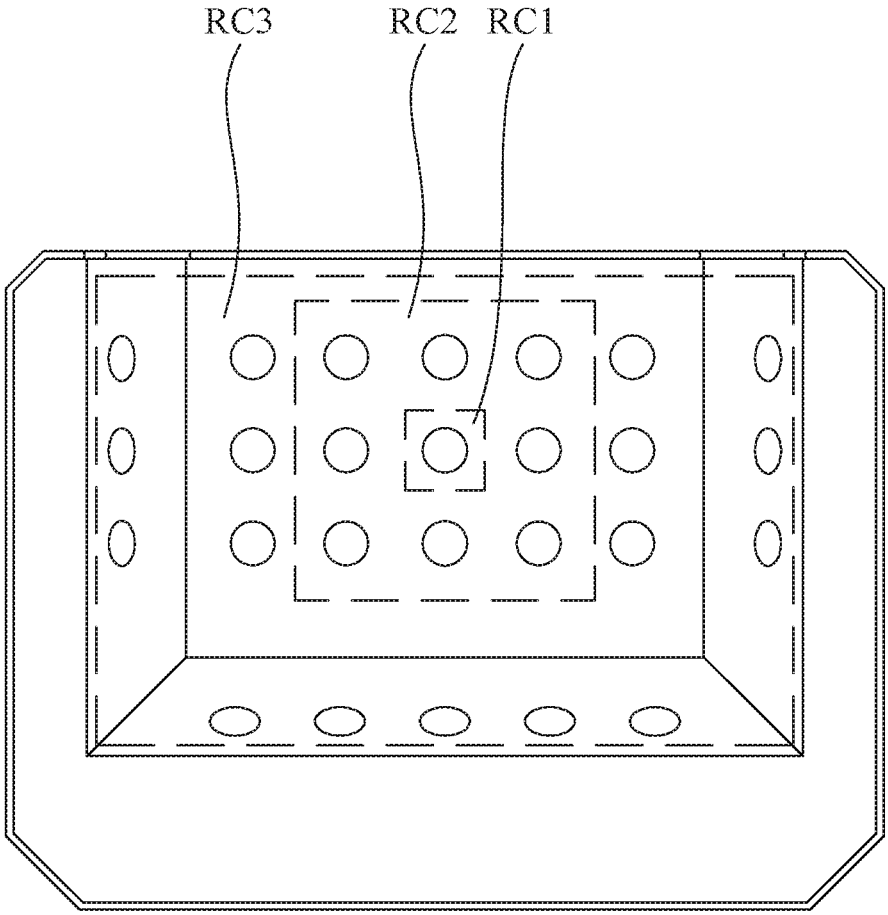
FIG. 14 is a third configuration of the UV LED module in the third embodiment of the invention.

In still another feasible embodiment, referring to FIG. 14, the UV LED unit groups are arranged in a radial manner. For example, the UV LED units are divided along a radially outward direction into a UV LED unit group RC1, a UV LED unit group RC2, and a UV LED unit group RC3 so that the switches of the UV LED units can be driven in a radially outward sequence, a radially inward sequence, or any other sequence in order to produce the desired buffering effect and enhance the curing of the gel.

Figure 15:
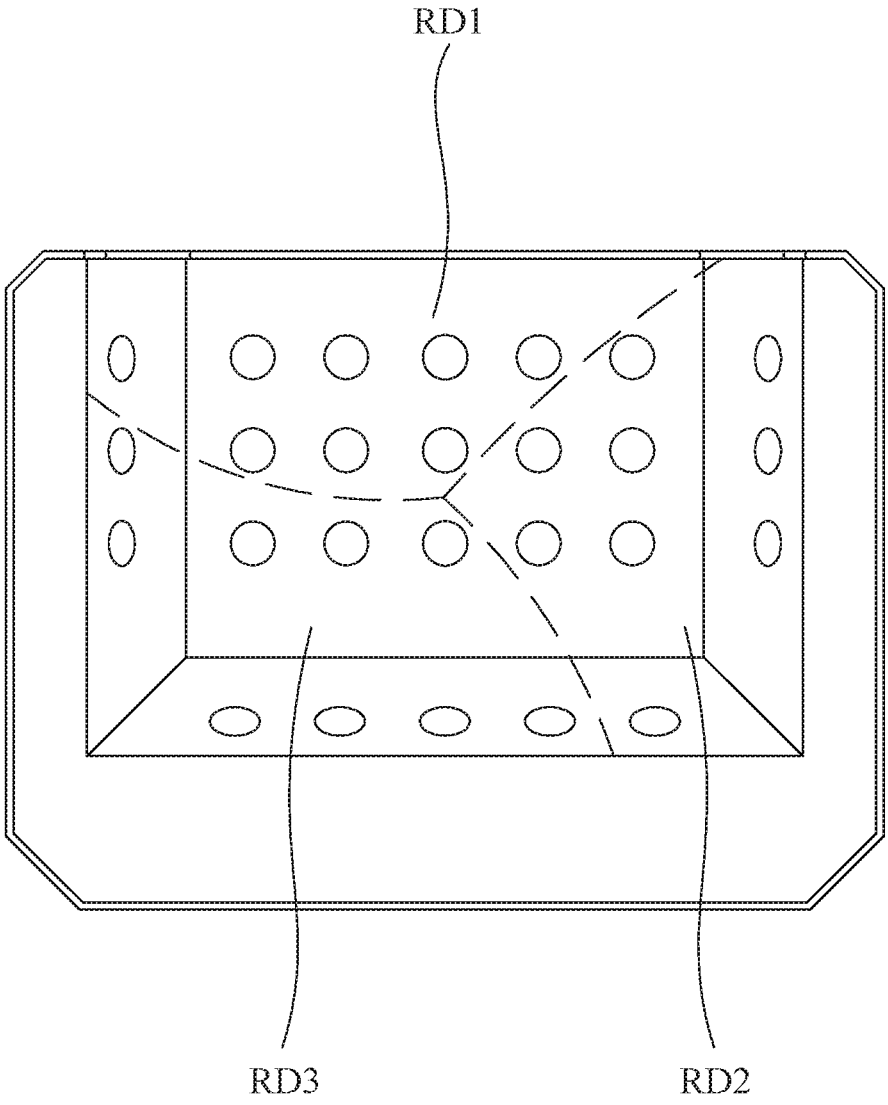
FIG. 15 is a fourth configuration of the UV LED module in the third embodiment of the invention.

In yet another feasible embodiment, referring to FIG. 15, the UV LED unit groups are arranged in an annular manner. For example, the UV LED units are divided annularly into a UV LED unit group RD1, a UV LED unit group RD2, and a UV LED unit group RD3 so that the switches of the UV LED units can be driven in a clockwise sequence, a counterclockwise sequence, or any other sequence in order to produce the desired buffering effect and enhance the curing of the gel.

Figure 16:
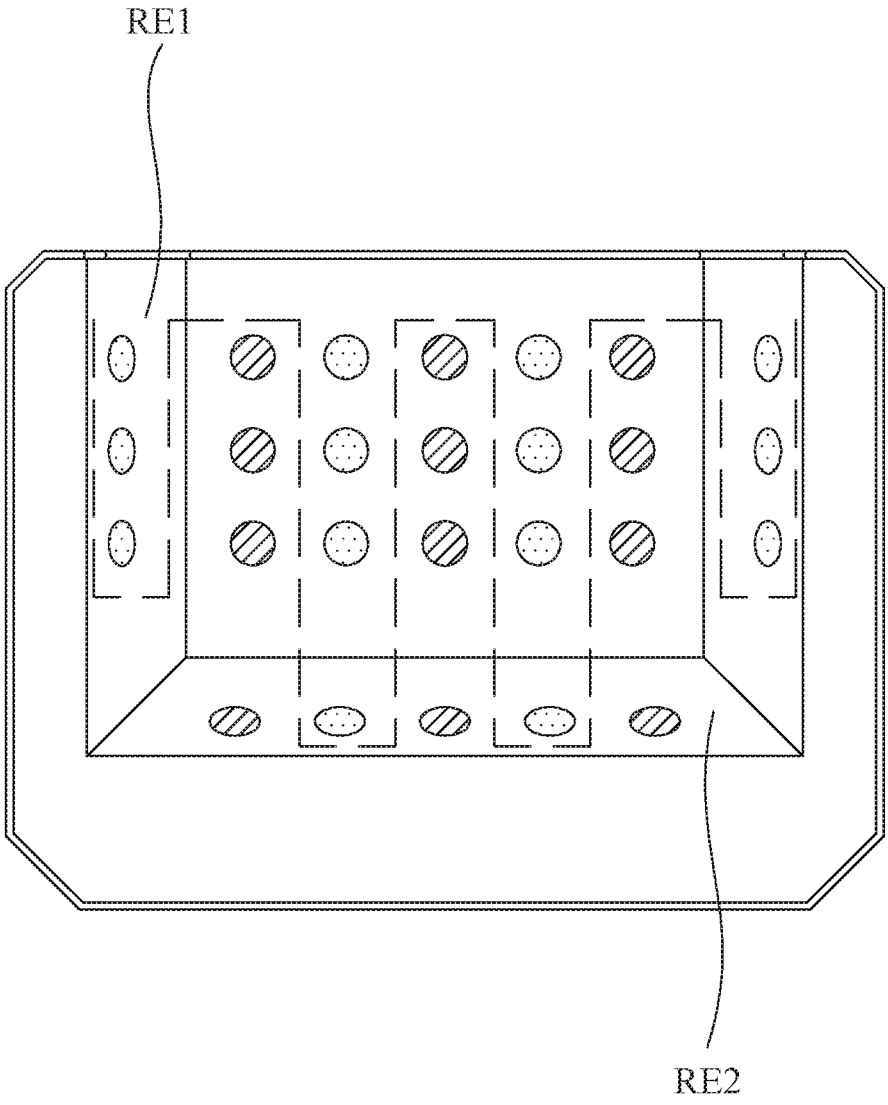
FIG. 16 is a fifth configuration of the UV LED module in the third embodiment of the invention.

In another feasible embodiment, referring to FIG. 16, the UV LED unit groups are alternately arranged so that the switches of the UV LED units can be driven successively or in any other sequence in order to produce the desired buffering effect and enhance the curing of the gel. An example of such alternate arrangement is to make a plurality of UV LED units (e.g., a row of hatched UV LED units in FIG. 16) and the neighboring UV LED units (e.g., the neighboring rows of dotted UV LED units) belong to different groups (e.g., the UV LED unit group RE1 and the UV LED unit group RE2). An alternate arrangement of the UV LED unit groups can be obtained by arranging the circuits of the UV LED units alternately.

It should be pointed out that the switching between the UV LED units in different areas can also be achieved by the signal modulator modulating the output power of the UV LED units; the present invention has no limitation in this regard. This alternative switching approach not only serves to control the brightness level of each UV LED unit group, but also enables a wider variation of brightness levels.

Figure 17:
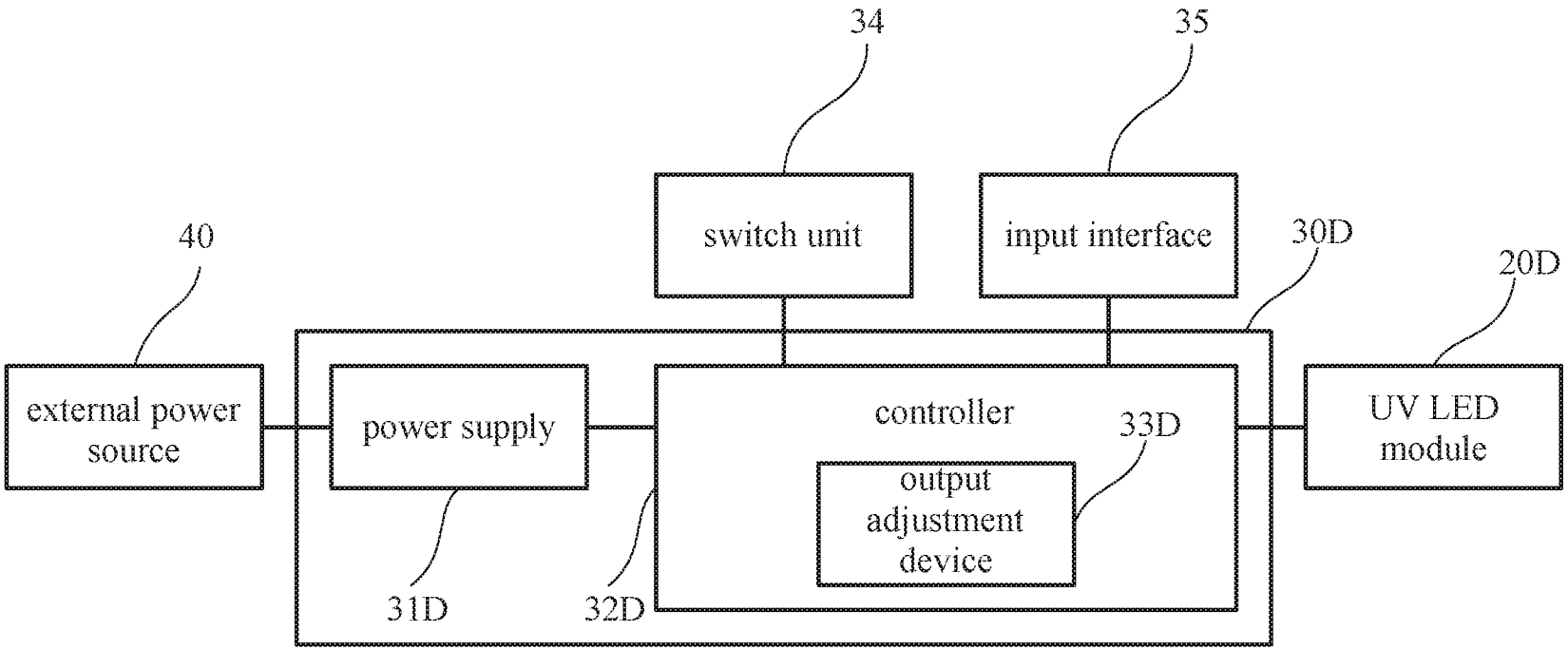
FIG. 17 is a block diagram of the fourth embodiment of the invention.

Based on the gel heat buffering solution of the present invention, still another feasible embodiment is presented below for illustration. Please refer to FIG. 17 for a block diagram of the fourth embodiment of the invention.

The fourth embodiment has generally the same exterior configuration as the first embodiment and is different from the first embodiment only in the hardware configuration for producing the buffering effect. For the sake of brevity, those portions of the fourth embodiment that are identical to their counterparts in the first embodiment will not be described repeatedly.

In the fourth embodiment, the switch control module 30D includes a power supply 31D, a controller 32D provided at the rear end of the power supply 31D, and an output adjustment device 33D.

A photocuring device according to the fourth embodiment further includes an input interface 35 connected or coupled to the switch control module 30D so that a control signal can be input through the input interface 35. The switch control module 30D is connected to the UV LED module 20D and includes the output adjustment device 33D. The output adjustment device 33D is configured to adjust the power output to the UV LED module 20D, and the adjustment to be made is based on the control signal received by the output adjustment device 33D.

The input interface 35 may be, but is not limited to, a turning knob, a dial, a pushing lever, a press-key, a touch-screen, a touchpad, a touch-sensitive paint interface, or an electronic device wirelessly connected to the switch control module, in order for the control signal to be input through a physical interface. In one feasible embodiment, the output adjustment device 33D is a pulse width modulator (PWM), a pulse frequency modulator (PFM), an amplitude modulator (AM), or a pulse amplitude modulator (PAM) so as to modulate the output signal according to the control signal input through the input interface, thereby controlling the brightness level of the UV LED module 20D. In another feasible embodiment, the output adjustment device 33D is a varistor (e.g., a varistor as is or a varistor integrated with an input interface) or a digital resistor in order to control the brightness level of the UV LED module 20D directly by analog voltage division; the present invention has no limitation in this regard.

The features of the fourth embodiment may also be incorporated into the embodiments described above. For example, an input interface 35 may be provided for each UV LED unit group that has a specific wavelength (or a specific group of wavelengths), or for each UV LED unit group that is located in specific area, in order to adjust the brightness level of each UV LED unit group individually; the present invention has no limitation in this regard.

While the present invention has been described in connection with certain exemplary embodiments, it is to be understood that the invention is not limited to the disclosed embodiments, but, on the contrary, intended to cover various modifications and equivalent arrangements included within the spirit and scope of the appended claims and equivalents thereof.

As above, the photocuring device of the present invention allows its irradiation power to be modulated, or more particularly allows its UV LED modules to light up gradually, to dim gradually, to dim gradually after lighting up gradually, or to light up gradually after dimming gradually. Thus, prolonged high-power irradiation will not result in a burning or otherwise uncomfortable sensation in the fingers involved. Moreover, the photocuring device of the present invention can prevent excessive change in instantaneous power, lest a user feel uncomfortable.

The above is the detailed description of the present invention. However, the above is merely the preferred embodiment of the present invention and cannot be the limitation to the implement scope of the present invention, which means the variation and modification according to the present invention may still fall into the scope of the invention.

What is claimed is:

1. A slow-start photocuring device, comprising:

a housing having an inner side provided with an internal cavity, wherein the inner side of the housing is further provided with one or a plurality of openings on one or two sides of the internal cavity;

an ultraviolet (UV) light-emitting diode (LED) module provided around the internal cavity, wherein the UV LED module has a light-emitting side facing the internal cavity; and a switch control module connected to the UV LED module, wherein the switch control module includes a signal modulator, the signal modulator activates a buffer mode when receiving a trigger signal, and the UV LED module in the buffer mode outputs light of a plurality of brightness levels sequentially according to an output signal of the signal modulator, and after a period of time executing the buffer mode, the switch control module activates an ordinary mode to drive the UV LED module to output stable brightness.

2. The slow-start photocuring device of claim 1, wherein the UV LED module in the buffer mode outputs light of a first brightness level and a second brightness level alternately according to the output signal of the signal modulator.

3. The slow-start photocuring device of claim 1, wherein the UV LED module in the buffer mode outputs light of a high brightness level and a zero brightness level alternately according to the output signal of the signal modulator.

4. The slow-start photocuring device of claim 1, wherein the UV LED module in the buffer mode outputs light of a plurality of brightness levels sequentially and then outputs light whose brightness level is gradually modulated from a first brightness level to a second brightness level according to the output signal of the signal modulator.

5. The slow-start photocuring device of claim 1, wherein the signal modulator is a pulse width modulator (PWM), a pulse frequency modulator (PFM), an amplitude modulator (AM), or a pulse amplitude modulator (PAM).

6. A slow-start photocuring device, comprising:

a housing having an inner side provided with an internal cavity, wherein the inner side of the housing is further provided with one or a plurality of openings on one or two sides of the internal cavity;

an ultraviolet (UV) light-emitting diode (LED) module comprising a plurality of UV LED units provided around the internal cavity, wherein the UV LED units are of different wavelengths, and the UV LED units have a light-emitting side facing the internal cavity; and a switch control module connected to the UV LED module, wherein the switch control module includes a signal modulator, the signal modulator activates a buffer mode when receiving a trigger signal, and the UV LED module in the buffer mode instructs the UV LED units of different wavelengths to output light of a plurality of brightness levels separately and sequentially according to an output signal of the signal modulator, and after a period of time executing the buffer mode, the switch control module activates an ordinary mode to drive the UV LED module steady in a stable wavelength.

7. The slow-start photocuring device of claim 6, wherein the signal modulator is a pulse width modulator (PWM), a pulse frequency modulator (PFM), an amplitude modulator (AM), or a pulse amplitude modulator (PAM).

8. A slow-start photocuring device, comprising:

a housing having an inner side provided with an internal cavity, wherein the inner side of the housing is further provided with one or a plurality of openings on one or two sides of the internal cavity;

an ultraviolet (UV) light-emitting diode (LED) module comprising a plurality of UV LED units provided in a plurality of different areas in the internal cavity respectively, and the UV LED module has a light-emitting side facing the internal cavity; and a switch control module connected to the UV LED module, wherein the switch control module includes a signal modulator, the signal modulator activates a buffer mode when receiving a trigger signal, and the UV LED module in the buffer mode instructs the UV LED units in the different areas to output light of a plurality of brightness levels separately and sequentially according to an output signal of the signal modulator, and after a period of time executing the buffer mode, the switch control module activates an ordinary mode to drive the UV LED module to output stable brightness.

9. The slow-start photocuring device of claim 8, wherein the signal modulator is a pulse width modulator (PWM), a pulse frequency modulator (PFM), an amplitude modulator (AM), or a pulse amplitude modulator (PAM).

* * * * *